US005941785A

United States Patent [19]

Bartels

[11] Patent Number: 5,941,785

[45] Date of Patent: Aug. 24, 1999

[54] FOOTBALL

[76] Inventor: McDonald C. Bartels, 38 Close Rd., Greenwich, Conn. 06831

[21] Appl. No.: 09/076,537

[22] Filed: May 12, 1998

[51] Int. Cl.[6] ..... A63B 41/08

[52] U.S. Cl. ..... 473/597; 473/596; 473/599

[58] Field of Search ..... 473/596, 597, 473/598, 599, 600, 603, 604, 607, 608, 609

[56] References Cited

U.S. PATENT DOCUMENTS

| | | | |
|---|---|---|---|
| 1,098,384 | 6/1914 | Hoffman . | |
| 1,240,866 | 9/1917 | Miller | 473/596 |
| 1,531,931 | 3/1925 | Hart | 473/597 |
| 1,931,429 | 10/1933 | Buckner et al. | 473/596 |
| 2,011,760 | 8/1935 | Gallinant | 473/596 |
| 2,143,409 | 1/1939 | Denkert . | |
| 2,244,503 | 6/1941 | Riddell . | |
| 2,448,731 | 9/1948 | Park . | |
| 2,931,653 | 4/1960 | Gow et al. . | |
| 3,708,170 | 1/1973 | Presnell . | |
| 4,531,737 | 7/1985 | Jacobson et al. | 473/597 |
| 4,822,041 | 4/1989 | Molitor . | |
| 4,928,962 | 5/1990 | Finley . | |
| 5,133,550 | 7/1992 | Handy . | |
| 5,269,514 | 12/1993 | Adler et al. | 473/596 |
| 5,316,294 | 5/1994 | Turangan . | |
| 5,577,724 | 11/1996 | Gandolfo | 473/597 |

*Primary Examiner*—Steven Wong
*Attorney, Agent, or Firm*—Frank J. Thompson

[57] ABSTRACT

A football is described having an array of laces positioned about the surface of the football whereby only a partial rotation of the football will result in a desired contact between the player's fingertips and one of the laces thereby reducing the time used by the player in finding the lace during play.

4 Claims, 3 Drawing Sheets

FOOTBALL

BACKGROUND OF THE INVENTION

1. Field of the Invention

This invention relates to an improved football. The invention relates more particularly to improvements to a football which facilitate handling and throwing a football.

2. Description of the Prior Art

A known football includes an outer leather casing and an inner inflatable air bladder which is inserted into the casing and then inflated to provide the football's oblate spheroidal shape. An elongated narrow opening is provided in the casing which provides access to the casing interior for inserting the bladder prior to inflation. The opening is secured by a closure lacing which is dressed through an array of lace holes extending along opposite edges of the opening. The lace is secured and the bladder is inflated directly through a bladder valve which extends through the casing thickness. Bladder type footballs have also been fabricated with a continuous outer rubber skin by molding processes. The latter retain the appearance of and outer characteristics of traditional leather casing footballs by integrally forming a simulated closure lace therein. Another known form of football is a bladderless type which is generally formed of relatively soft polymeric plastic material and is shaped and sized to conform in configuration with the bladder type of football. While not requiring a lace for closure, the bladderless type includes a simulated closure lace integrally formed in the surface of the football.

In view of a football's size, shape and surface texture, a player handling the football and preparing to pass it often becomes comfortable with gripping the ball so that the player's fingertips lay on and grip the closure lacing. This aids not only in gripping the ball but also enhances the spin of the ball and thus the spiral trajectory of the ball and distance of a pass. However, when the ball is not initially received by the player with this desired orientation for passing it, the player will ordinarily rotate the ball in his hands until it is orientated with the desired contact between the laces and player's finger tips. At times, a player may be required to effect a full half rotation of the football to establish this orientation. A problem with this practice is that in today's relatively fast football game, it takes time to orient the ball and although it may take only seconds or fraction of a second, the passer's attention is momentarily diverted from the other aspects of play. Coaches continuously attempt to have the passer simply grip the ball as received but finding the laces remains a continuing problem.

SUMMARY OF THE INVENTION

Accordingly, it is an object of this invention to provide an improved football

Another object of the invention is to provide a football having an improved arrangement for gripping the football.

Another object of the invention is to provide an improved arrangement for a football which facilitates orientation of the football in a player's hands.

A further object of the invention is to provide an improved football which reduces the time in gripping a lace of the football.

Still another object of the invention is to provide an improved arrangement for gripping both bladder and bladderless types of footballs.

In accordance with features of the invention, the time required by a football player to orient a football so that the lace on the football is aligned in contact with the player's finger tips is reduced by providing an array of laces about the surface of the football whereby only a partial rotation of the football will result in the desired contact between the player's fingertips and one of the laces. These features are applicable with both bladder and bladderless footballs. With a bladder football, the array includes at least one closure lace and one simulated lace. With a bladderless football, each of the laces comprises a simulated lace. In a preferred embodiment of the invention used with a bladder football, the array of laces comprises a closure lace and one or more simulated laces positioned on the surface of the football and radially spaced apart.

BRIEF DESCRIPTION OF THE DRAWINGS

These and other features and objects of the invention will become apparent with reference to the following specification and to the drawings, wherein.

DETAILED DESCRIPTION

Figure 1:
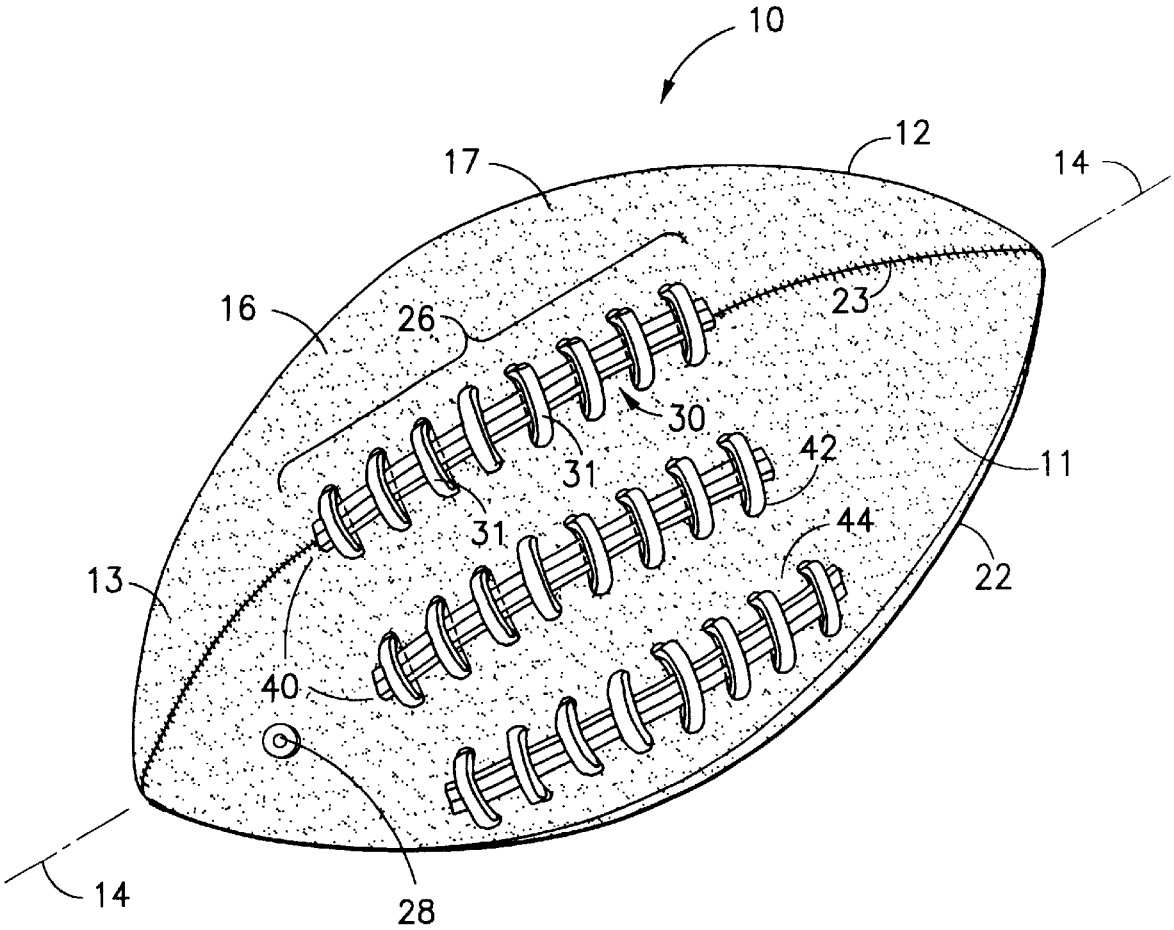
FIG. 1 is a perspective view of a bladder type football embodying the invention and illustrating an array of laces positioned about the football.

Reference is now to the drawings and particularly to FIGS. 1–5. The same reference numerals are used in the different figures of the drawings to reference football members performing the same function. A football 10 is shown to comprises a generally oblate spheroidal shaped body 12 having a longitudinal axis 14. Football 10 of FIGS. 1–5 is a bladder type of football with an outer casing 16 having a surface 17 and an inflatable bladder 18 (FIGS. 4 and 5) positioned within the casing 16. Casing 16 is formed of cooperating quarter sections 11, 13, 15 and 20 which are fabricated of leather, rubber or synthetic polymeric plastic material shaped to be joined at longitudinal seams 22–25 by stitching, heat sealing or other conventional process. As shown in FIGS. 1–5, the leather casing surface 17 is embossed with a pebble-like grain for enhancing the grip. With footballs having a synthetic, non-leather surface 17, this grain is applied during injection or compression molding of the surface or alternatively embossing using heat and pressure. One of the seams, 23, includes an elongated opening, not shown in the inflated ball, and referenced generally by line 26 (FIG. 1), extending along the seam 23 in the direction of the longitudinal axis 14 and through which the bladder 18 is inserted within the casing 16 prior to inflation. The inflatable bladder 18 is made of a butyl rubber or other suitable material and includes a valve 28 which is vulcanized in a wall segment of the bladder and extends through the casing thickness. The seam opening 26 is closed by a two piece lace 30 formed of cowhide, nylon or vinyl or other suitable material which is referred to herein when assembled to close the opening 26 as the closure lace. An array of holes, not shown, and formed in the casing are arrayed on opposite sides of the opening 26 and the two piece lace is dressed through the holes in a well known manner and the opening is thereby held closed by loops 31 of the lace extending across the opening and through the holes. Upon closure, the edges of the casing butt together as shown by reference numeral 29 in FIG. 5. The foregoing closure lace 30 assembly has a thickness or height 32 which extends in a direction normal to the casing surface, above the surface, a width 34 and an arcuate length 36. This closure lace arrangement provides a grip for the football when in contact with the player's fingertips.

An array 40 of laces (FIG. 1) is provided which reduces the time for a player's fingertips to contact a lace. In FIG. 1, the array 40 comprises the closure lace 30 and simulated laces 42 and 44 on the surface 17 of casing 16 which are similar in feel to the player's finger tips and in construction to that of the closure lace 30. Laces of array 44 are simulated laces in that while similar in arrangement above the casing surface to the closure lace 30, they do not function to close an opening in the casing. Laces 42 and 44 are preferably integrally formed in the casing surface to simulate a closure lace in height 32 above the surface, in width 34 and length 36 of the closure lace 30. When the casing 16 is fabricated of leather, the simulated laces are separately fabricated of a similar material as the closure lace, assembled into a lace configuration similar to the closure lace 30 and mounted to the surface 17 by an adhesive or by stitching. Alternatively, an array of holes, not shown and similar to the hole array which the closure lace secures, is provided in the casing at a location at which the simulated lace is positioned and the simulated lace is dressed through and secured to this hole array to simulate the closure lace arrangement. With a polymer plastic casing, the lace array is integrally formed with the casing material upon molding of the casing. The simulated laces are configured to have substantially the same height 32, width 34 and length 36 as the closure lace so that a simulated lace presents the same feel to the player handling the ball as the closure lace.

Figure 2:
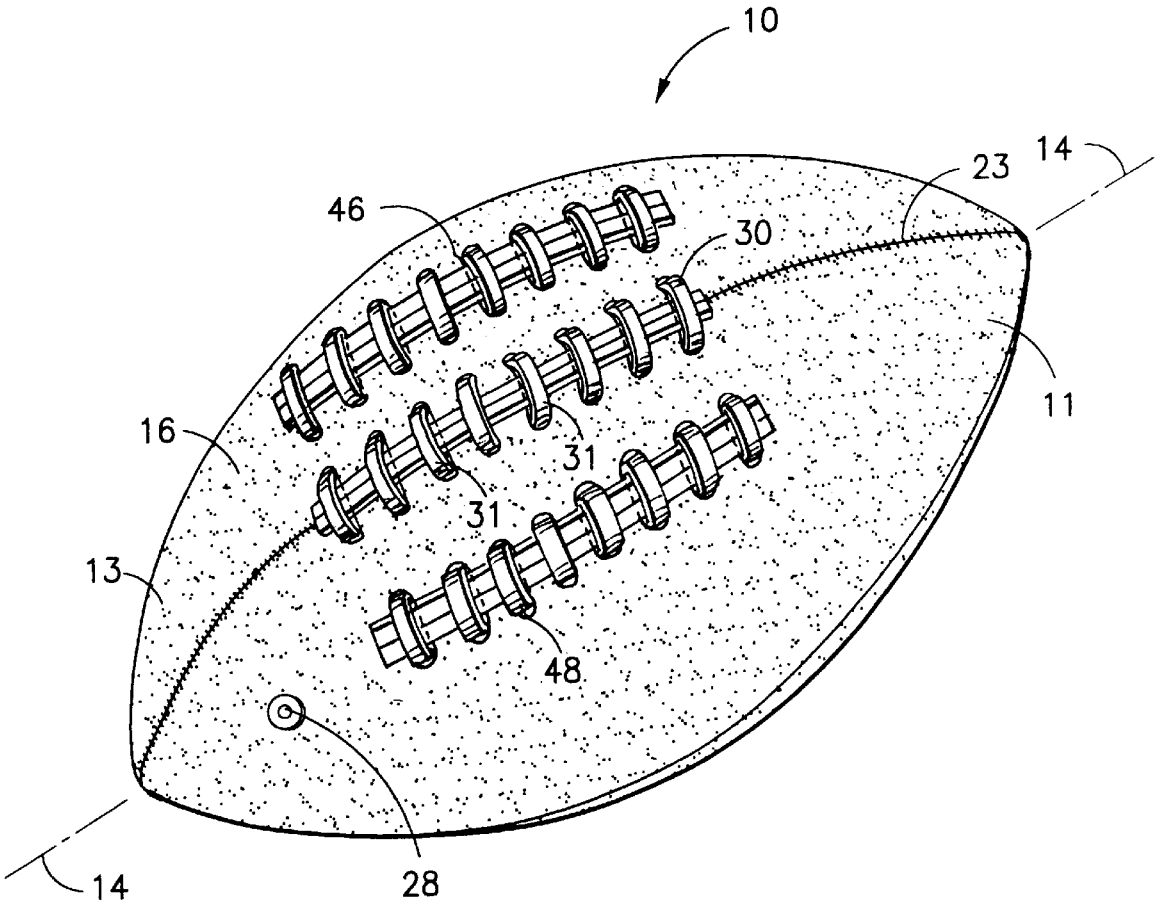
FIG. 2 is a perspective view of another bladder type football constructed in accordance with features of this invention and illustrating an alternative array of laces positioned about the football.
Figure 3:
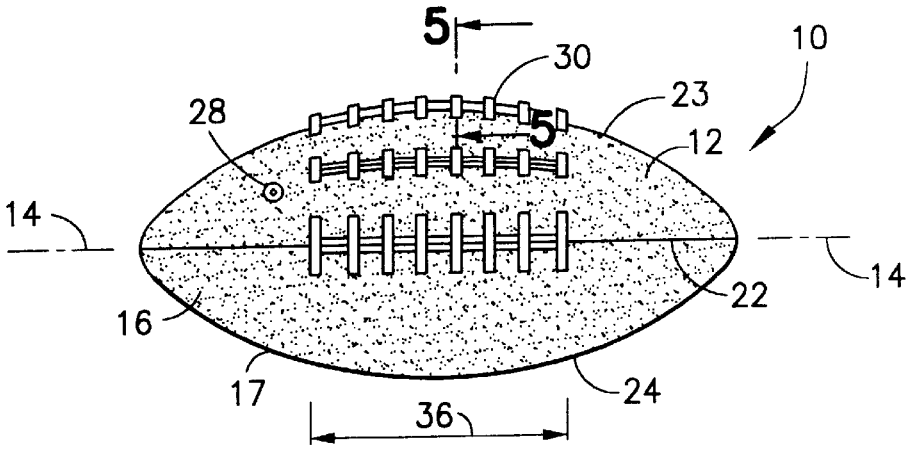
FIG. 3 is a side, elevation view of a bladder type of football constructed in accordance with features of this invention and illustrating an alternative array of laces positioned about the football.
Figure 4:
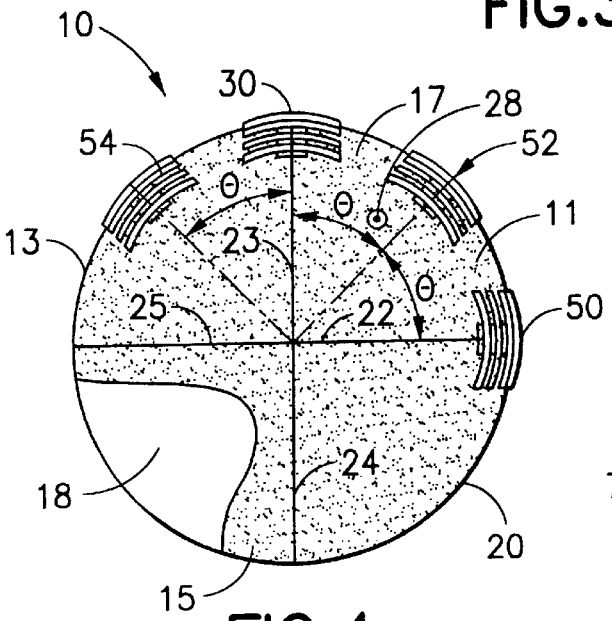
FIG. 4 is a front elevation view of the football of FIG. 3, with a casing surface partly broken away and illustrating an inflated bladder surface.
Figure 5:
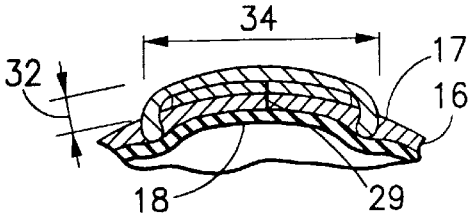
FIG. 5 is an enlarged section view taken along lines 5—5 of FIG. 3 illustrating a closure lace.

With the lace array 44 (FIG. 1), the simulated lace 42 is radially spaced apart on the surface 17 of the casing 16 from the closure lace 30 and extends generally parallel to the closure lace in the direction of the longitudinal axis 14. The spacing between adjacent laces can vary but it is preferable that no more than three laces of an array be located in a casing quarter section. In FIG. 1, the closure lace 30 is partly positioned on each casing quarter sector 11 and 13 and simulated laces 42 and 44 are shown to be located on the same quarter sector 11 of the casing. Other spacings can be provided in accordance with this invention. In FIG. 2, an array of three laces is shown to comprise a closure lace 30 and simulated laces 46 and 48. Laces 48 and 46 are positioned on opposite quarter sectors 13 and 11, respectively of the casing. FIGS. 3–4 illustrate an array of four laces including the closure lace 30 and a simulated lace 50. The latter is positioned at a sector seam 22 and overlaps adjacent casing quarter sectors 11 and 20. A simulated lace 52 positioned between the laces 30 and 50 and a simulated lace 54 positioned on another quarter sector 13.

The closure and simulated laces are radially separated by an angle θ subtending a line extending through the longitudinal axis 14 and through a center line of the laces as illustrated in FIG. 4. Simulated laces are also radially spaced apart by an angle θ. The angle θ can have a value of up to 180° in accordance with features of this invention and preferably a value of between 30° and 90°.

Figure 7:
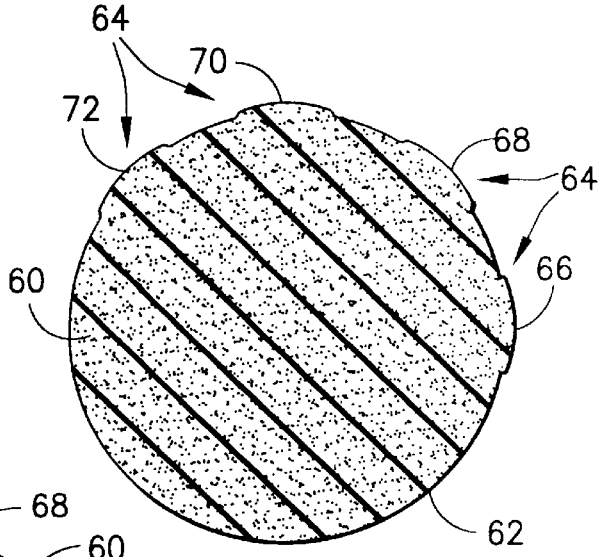
Figure 6:
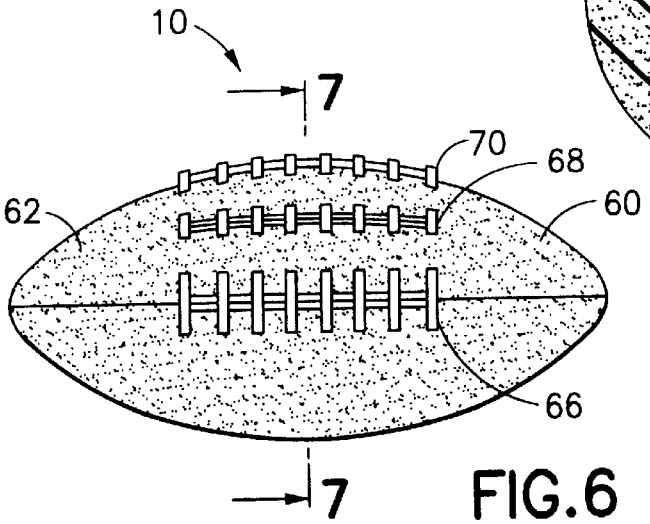
FIG. 6 is a side elevation view of a bladderless football embodying features of the invention; and, FIG. 7 is an enlarged cross sectional view of the bladderless football of FIG. 6 taken along lines 7—7 of FIG. 6.

FIGS. 6 and 7 illustrate a bladderless football incorporating the features of this invention. The football of FIGS. 6–7 comprises a body 60 formed of a polymer plastic material as for example a resilient foam material such as foam rubber, a foam plastic or the like having a surface 62. An array 64 of simulated laces 66, 68, 70 and 72 are positioned about the surface 62 of body 60 in the same manner as with the football described herein with respect to FIGS. 1–4. In this bladderless type of football, each lace is simulated and is formed integrally in the surface during molding.

In use, a player upon receiving the football will rotate the ball in his hands until his fingertips contact a lace of the array. The contacted lace is a closure or simulated lace in a bladder type of football or a simulated lace in a bladderless football. Finding the lace by rotating the football will require less time than heretofore since there are a plurality of laces and the amount of time for orienting the player's fingertips will be reduced.

In an illustrative example not deemed limiting in any respect, a bladder type of football with leather casing has a length along its longitudinal axis of about 11.000 inches (28.205 cm), a diameter at the center of the ball of about 7.000 inches (17.949 cm), a girth about the football at the center of its longitudinal axis of about 21.00 inches (53.846 cm), a lace length 30 of about 4.250 inches (10.897 cm), a lace width 34 of about 1.000 inches (2.564 cm), and a lace height 32 of between about 0.094 inches (2.350 mm) and 0.188 inches (4.700 mm). A simulated lace of similar dimensions is spaced peripherally about the surface 17 of the ball from the closure lace 30 by about 2.65 inches (6.731 cm) and is mounted to the surface with an epoxy adhesive. This arrangement comprises a radial spacing θ of about 45° between laces.

An improved football arrangement has thus been disclosed which enhances play by facilitating a player obtaining a desired grip on the football by providing an array of laces, one of which are contacted by the player's fingertips for passing the ball. The time required for the player to achieve this orientation is thus reduced.

While there has been described particular embodiments of the invention, it will be apparent to those skilled in the art that variations may be made thereto without departing from the spirit of the invention and the scope of the appended claims.

What is claimed is:

1. A football having an improved grip for handling and passing the football comprising:

a.) a generally oblate spheroidal shaped football having a casing and a single inflatable bladder positioned within said casing;

b.) said casing having sector segments joined at seams of said casing;

c.) said casing including an outer gripping surface and a longitudinal axis thereof;

d.) an elongated, axially extending opening positioned along one of said seams for inserting said bladder into said casing, said opening centrally located along said seam;

e.) an array of generally parallel extending elongated laces including a closure lace having a length coextensive with the length of said opening and at least one simulated lace positioned on said casing surface and having a length substantially equal to the length of said closure lace;

f.) each of said laces having a height thereof extending in a direction normal to said surface, a width extending transverse to said axis and a length thereof extending in the direction of said longitudinal axis;

g.) said closure lace positioned along said opening for closing said opening: and, h.) said laces spaced apart radially about the surface of said casing by between about 30° and 60°.

2. The football of claim 1 including first and second simulated laces and said closure lace is radially positioned between said simulated laces.

3. The football of claim 1 wherein said array of laces includes first, second and third simulated laces and said closure lace is radially positioned between said first and second simulated laces.

4. The football of claim 1 where said laces are radially spaced apart by about 45°.

* * * * *